US008267298B2

(12) United States Patent
Zahner et al.

(10) Patent No.: US 8,267,298 B2
(45) Date of Patent: Sep. 18, 2012

(54) COMBUSTION-ENGINED SETTING TOOL

(75) Inventors: Mario Zahner, Chur (CH); Iwan Wolf, Untervaz (CH); Stefan Boenig, Achberg-Esseratsweiler (DE)

(73) Assignee: Hilti Aktiengesellschaft, Schaan (LI)

( * ) Notice: Subject to any disclaimer, the term of this patent is extended or adjusted under 35 U.S.C. 154(b) by 1178 days.

(21) Appl. No.: 11/786,693

(22) Filed: Apr. 11, 2007

(65) Prior Publication Data

US 2007/0240683 A1 Oct. 18, 2007

(30) Foreign Application Priority Data

Apr. 13, 2006 (DE) ..... 10 2006 000 179

(51) Int. Cl.
*B25C 1/08* (2006.01)

(52) U.S. Cl. ..... 227/10; 227/9

(58) Field of Classification Search ..... 227/8–10
See application file for complete search history.

(56) References Cited

U.S. PATENT DOCUMENTS 4,773,581 A * 9/1988 Ohtsu et al. ..... 227/10
5,181,495 A * 1/1993 Gschwend et al. ..... 123/46 SC
6,260,519 B1 * 7/2001 Phillips ..... 123/46 R
6,425,354 B1 * 7/2002 Buchel et al. ..... 123/46 R
6,460,507 B2 * 10/2002 Thieleke et al. ..... 123/260
6,463,894 B2 * 10/2002 Hasler et al. ..... 123/46 R
6,505,767 B2 * 1/2003 Thieleke et al. ..... 227/10
6,520,127 B1 * 2/2003 Thieleke et al. ..... 123/46 R
6,843,401 B2 * 1/2005 Favre-Bulle ..... 227/10
6,892,524 B1 5/2005 Van Erden et al.
7,284,510 B2 * 10/2007 Schiestl et al. ..... 123/46 H
7,383,974 B2 * 6/2008 Moeller et al. ..... 227/8
2004/0104258 A1 * 6/2004 Favre-Bulle ..... 227/10
2004/0108353 A1 6/2004 Wolf et al.
2004/0134961 A1 * 7/2004 Wolf et al. ..... 227/10
2004/0232191 A1 * 11/2004 Schiestl et al. ..... 227/10
2006/0054116 A1 3/2006 Schiestl et al.
2007/0138230 A1 * 6/2007 Gschwend et al. ..... 227/10

* cited by examiner

*Primary Examiner* — Lindsay Low
(74) *Attorney, Agent, or Firm* — Abelman, Frayne & Schwab

(57) ABSTRACT

A combustion-engined setting tool for driving fastening elements such as, e.g., nails, bolts, or pins in a workpiece, includes a plate-shaped member (17) axially displaceable in the tool combustion chamber (14), a member (33) for displacing the plate-shaped member (17), a holding device (30) for retaining the plate-shaped member (17) at an axial end (15) of the combustion chamber (14) against action of the displacing member (33), with the holding device (30) having magnetic elements (31) for producing a holding force for retaining the plate-shaped member (17) and a device for overpowering the holding force produced by the magnetic elements (31).

9 Claims, 3 Drawing Sheets

COMBUSTION-ENGINED SETTING TOOL

BACKGROUND OF THE INVENTION

1. Field of the Invention

The present invention relates to a setting tool for driving fastening elements such as, e.g., bolts, nails, pins in a constructional component and including a combustion chamber for an oxidant-fuel gas mixture, a guide cylinder adjoining the combustion chamber at one of its ends, a setting piston displaceable in the guide cylinder for driving a fastening element in the workpiece, a plate-shaped member axially displaceable in the combustion chamber for creating turbulence therein, means for displacing the plate-shaped member, and a holding device for retaining the plate-shaped member at an axial end of the combustion chamber against action of the displacing means.

2. Description of the Prior Art

Setting tools of the type described above are driven with gaseous fuels or liquid fuels which are evaporated before combustion. The setting energy for driving in a fastening element is obtained by combustion of an oxidant-fuel mixture in a combustion chamber and is transmitted to the to-be-driven-in fastening element by a setting piston. As an oxidant, e.g., oxygen from the environmental air is used. For optimal energy efficiency, it is desirable that the combustion of the oxidant-fuel mixture takes place in a turbulent flow regime.

U.S. Pat. No. 6,892,524 discloses a combustion-engined setting tool having a combustion chamber for combusting an oxidant-fuel mixture, a guide cylinder, and a setting piston displaceable in the guide cylinder and driven by a working pressure produced by combustion of the oxidant-fuel mixture. In the combustion chamber of the setting tool, there is arranged a separation plate provided with holes and which is displaceable along a longitudinal axis of the combustion chamber with another plate. The combustion chamber further has a combustion chamber rear wall displaceable relative to the separation and another plates.

After the setting tool was pressed against a constructional component, the separation plate and another plate are located at an axial end of the combustion chamber remote from the setting piston. The separation plate is retained on another plate against a spring biasing force by a latch mechanism. The latch mechanism is actuated by the tool actuation switch, and in response to the actuation of the switch, the separation plate is lifted off another plate by a spring and is displaced a certain amount in the combustion chamber, dividing the combustion chamber in two sub-chambers.

The two sub-chambers are connected with each other by openings provided in the separation plate.

The drawback of the setting tool described above consists in that the latch mechanism consists of a large number of parts interacting with each other, generating frictional forces. The parts are also subjected to soiling and require narrow tolerances. All this can lead to high actuation forces or even to the failure of the latch mechanism Accordingly, an object of the present invention is a setting tool of a type described above in which the drawbacks of the known setting tool are eliminated.

SUMMARY OF THE INVENTION

This and other objects of the present invention, which will become apparent hereinafter are achieved by providing a setting tool of the type described above and in which the holding device has magnetic means for providing a holding force for retaining the plate-shaped member, and means for overpowering the holding force produced by the magnetic means.

With magnetic means, it is possible to retain the plate-shaped member wear-free and without substantial technical expenses. The overpowering means, meanwhile, can be so formed that it overcomes the holding force of the magnetic means by magnetic means, e.g., by using switchable oppositely oriented magnets, or be so formed that it applies to the plate-shaped member a force acting in a direction opposite to the direction the holding force of the magnetic means acts and which is greater than the holding force of the magnetic means.

Advantageously, the overpowering means is actuated by the tool actuation switch. Thereby, it is possible to release the plate-shaped member shortly before ignition of the air-fuel mixture that fills the combustion chamber, whereby an optimally large turbulence can be generated by the movable plate-shaped member at the start of the combustion. E.g., there can be provided a slide connected with the actuation switch and which, upon actuation of the actuation switch, would lift the plate-shaped member off the magnetic means so far that the displacement force of displacing means which acts on the plate-shaped member, is sufficient to displace it through the combustion chamber.

According to a technically advantageous embodiment of the present invention, overpowering means includes a displacement member, displaceable by the displacing means and a lock member connected with the actuation switch for locking the displacement member in its initial position in a non-actuated position of the actuation switch.

Thereby, the plate-shaped member is reliably held on the magnetic means and, in this position, is not subject to action of large forces.

It is advantageous when the displacing means is formed as a spring, and the setting tool has a press-on element which preloads the displacing means-forming spring against the displacement member. Thereby, the solution according to the present invention can be technically easily realized.

Alternatively, the displacing means can also include magnets which are so arranged that they push themselves off. These magnets can be formed as electromagnets.

Advantageously, the displacement member cooperates with a guide member that engages the plate-shaped member which enables, in a simple way, disengagement of the displacing means, together with the displacement member, from the plate-shaped member. Thereby, the displacing means, such as, e.g., a spring, can be preloaded against the displacement member, without acting directly on the plate-shaped member.

Advantageously, the guide member is formed as a bar-shaped member and is displaceable, at least partially in a first guide provided on the guide cylinder. Thereby, guidance of the plate-shaped member is achieved in a simple manner.

Advantageously, the displacement member is also formed as a bar-shaped member which is at least partially displaceable in a second guide provided on the press-on element of the displacement member relative to the guide member and, thereby, a reliable cooperation of the two members is achieved.

It is advantageous when the magnetic means is formed of at least two magnetic elements for holding the plate-shaped member. Thereby, a uniform application of the holding force to the plate-shaped member is insured.

In a technically simply manufactured and low-cost embodiment, the magnetic means is formed as permanent magnetic means.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENTS

Figure 1:
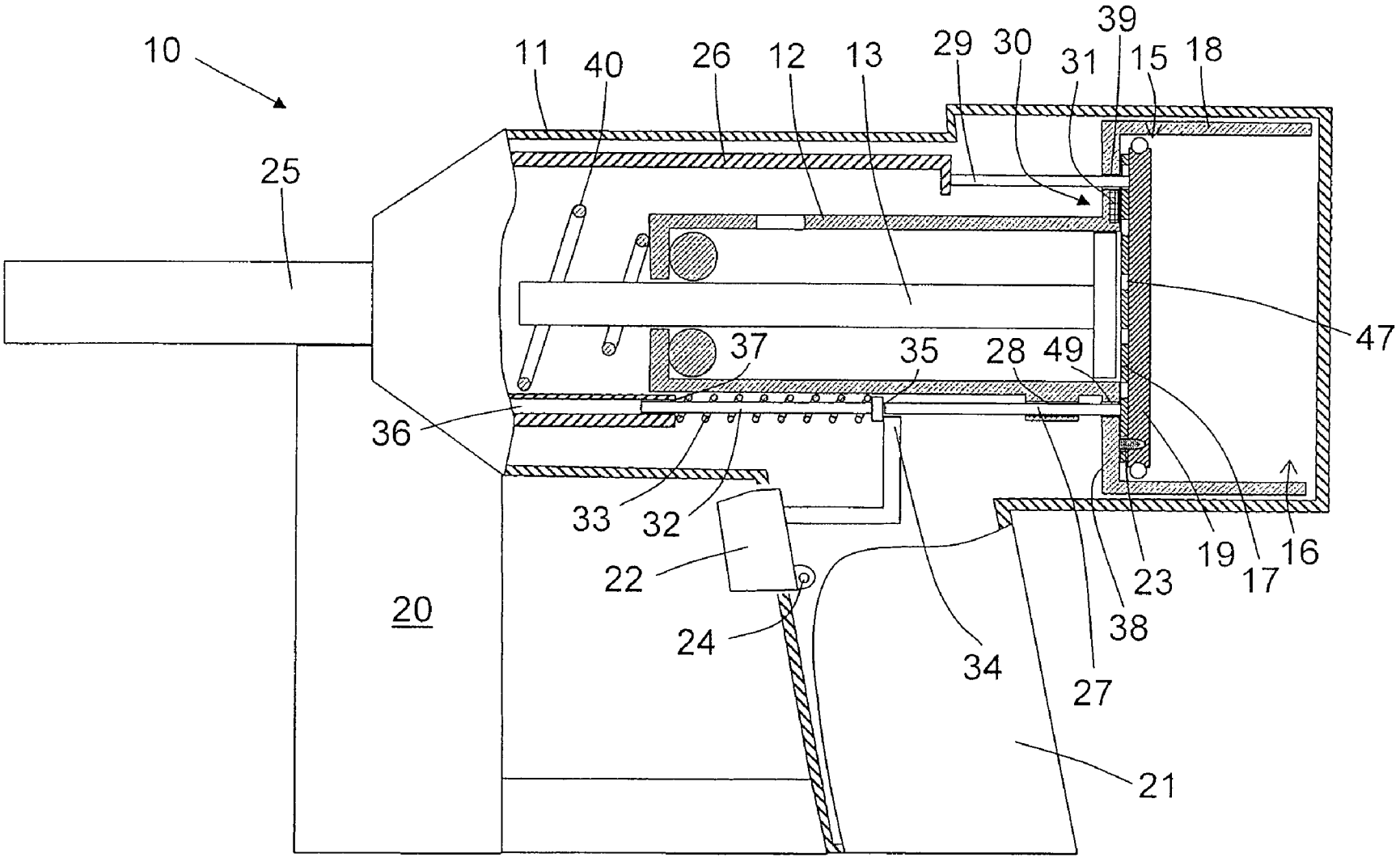
FIG. 1 a partially cross-sectional view of a setting tool according to the present invention in its initial position.
Figure 2:
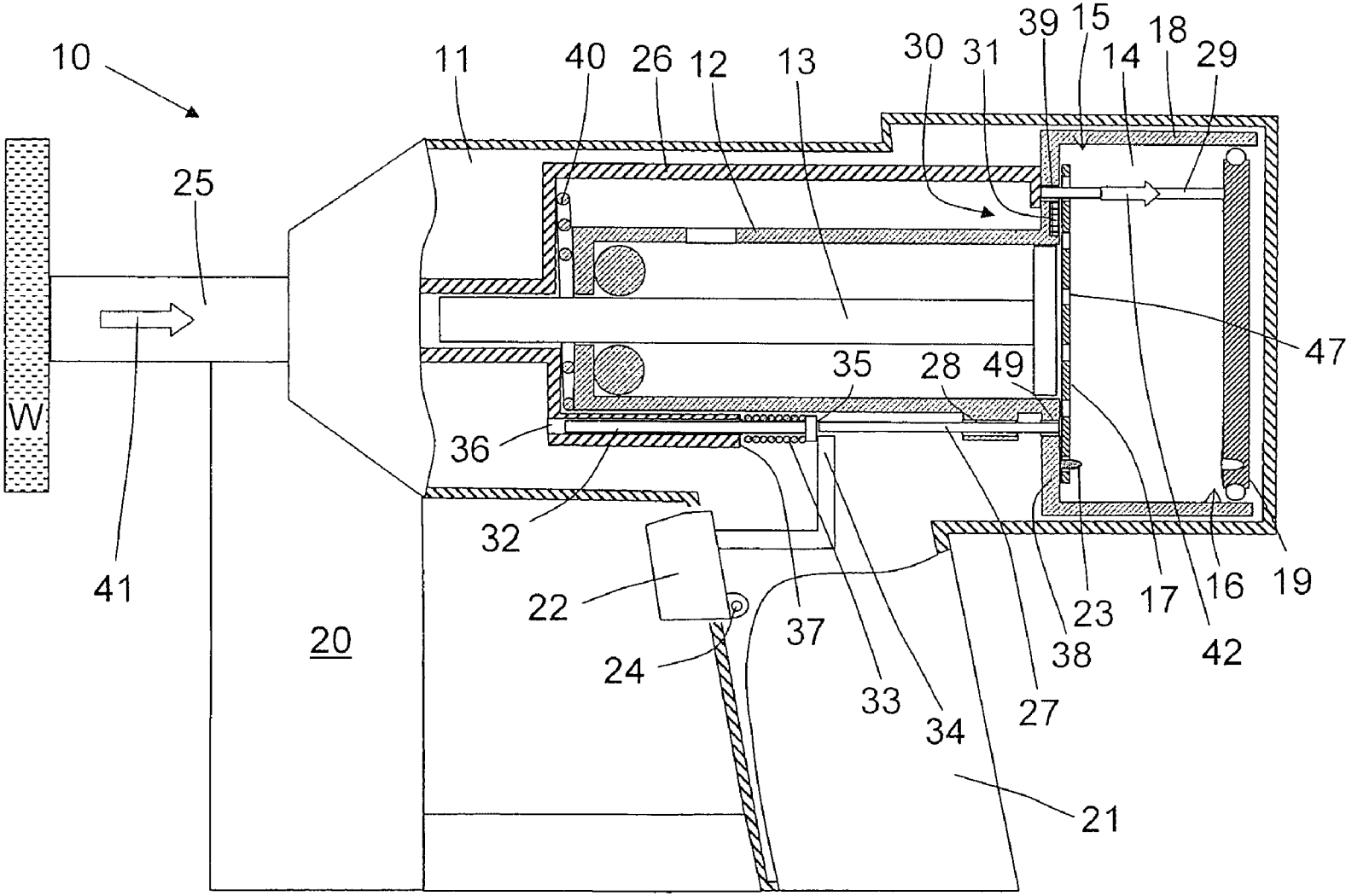
FIG. 2 a partially cross-sectional view of the setting tool shown in FIG. 1 in a position in which the tool is pressed against a constructional component.
Figure 3:
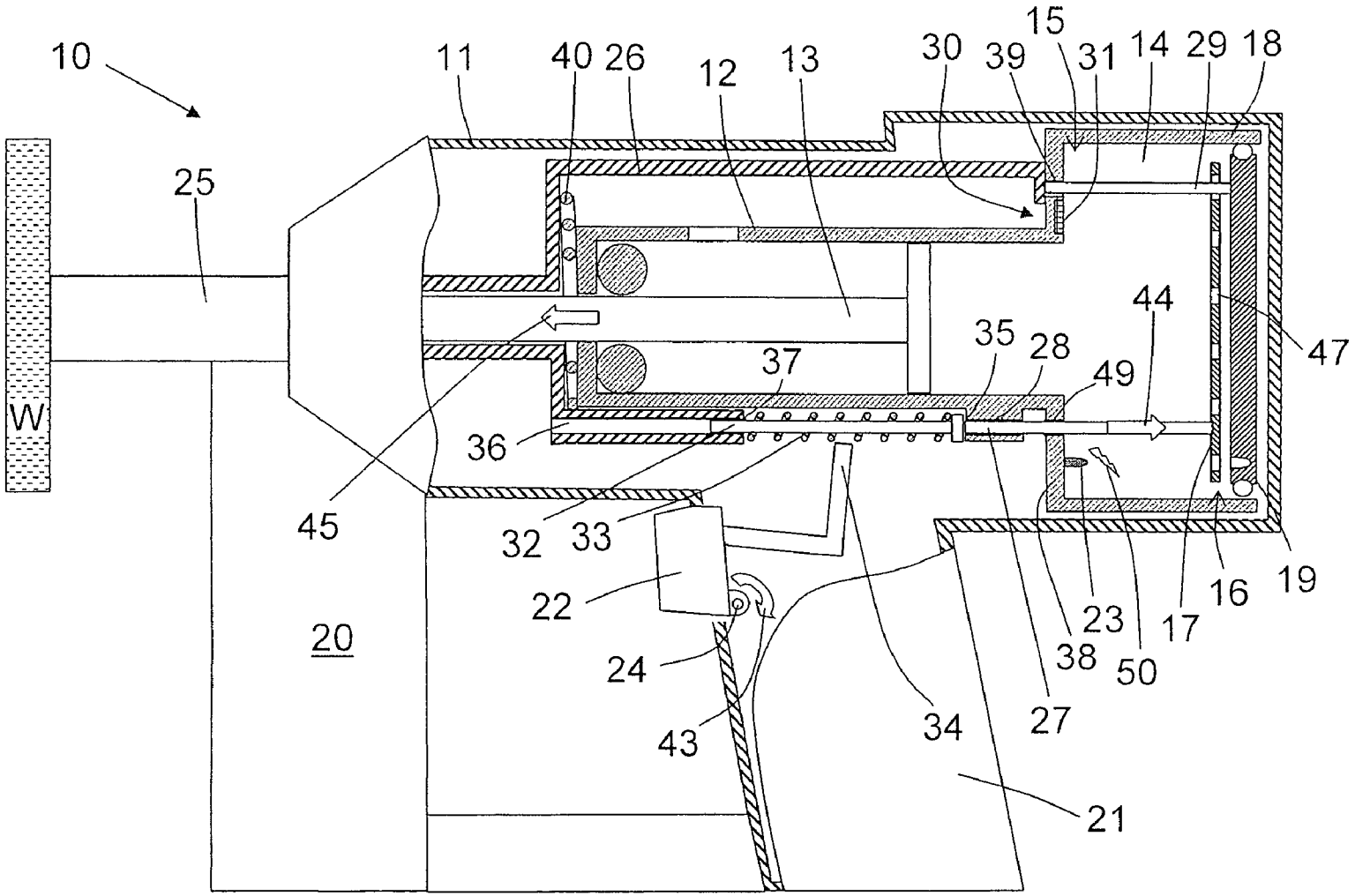
FIG. 3 a partially cross-sectional view of the setting tool shown in FIG. 1 in a position in which the tool is pressed against a constructional component and the actuation switch is actuated.

A setting tool 10 according to the present invention, which is shown in FIGS. 1-3, is driven with fuel gas that is stored in a fuel reservoir, not shown, in form of a liquefied gas. Instead of the fuel gas, a liquid fuel, which can be evaporated, such as, e.g., alcohol or gasoline can be used. The setting tool 10 includes a housing 11 and a setting mechanism which is located in the housing 11 and with which a fastening element, not shown, can be driven in a workpiece W when the setting tool 11 is pressed against the workpiece W and is actuated. The setting mechanism includes, among others, a combustion chamber 14 for an oxidant-fuel gas mixture, a guide cylinder 12 in which a setting piston 13 is supported for an axial displacement, and a bolt guide 25 that adjoins the guide cylinder at its end remote from the combustion chamber 14. The bolt guide 25 serves for guiding the fastening element such as, e.g., a bolt or a nail, and forms simultaneously a functional part of a press-on device that also includes a press-on element 26 connected with the bolt guide 25. Fastening elements can be stored, e.g., in a magazine 20 on the setting tool 10. Both the bold guide 25 and the press-on element 26 are axially displaceable relative to the guide cylinder 12 and to this end are displaceably arranged in the housing 11, whereas the guide cylinder 12 is fixedly secured in the housing 11. The press-on element 26 is supported by a spring 40 against an end of the guide cylinder 12 remote from the combustion chamber 14.

The combustion chamber 14 expands in a cylindrical combustion chamber sleeve 18 formed at the end of the guide cylinder 12 remote from the bolt guide 25. A combustion chamber rear wall 19 is displaceable in the combustion chamber sleeve 18. The combustion chamber rear wall 19 is preferably fixedly connected with the press-on element 26 by a rod-shaped set member 29. The set member 29 extends into the combustion chamber 14 through a first opening 39 in a combustion chamber wall 38. In the initial position of the setting tool 10 shown in FIG. 1, in which the combustion chamber 14 is in its collapsed condition, the combustion chamber rear wall 19 abuts a first end 15 of the combustion chamber 14 (with reference to the expanded condition of the combustion chamber 14), or of the combustion chamber sleeve 18. The first end 15 of the combustion chamber 14 of the combustion chamber sleeve 18 is located adjacent to the setting piston 13 and to the combustion chamber wall 38. Between the combustion chamber rear wall 19 and the setting piston 13, there is provided a plate-shaped member 17 that abuts the first end 15 of the combustion chamber 14 and is pierced with openings 47. The plate-shaped member 17 serves as turbulence-generating means. The plate-shaped member 17 is held on the first end 15 of the combustion chamber 14 or of the combustion chamber sleeve 18, in the initial position shown in FIG. 1, by a holding device 30 having a plurality of magnetic elements 31.

On the housing 11, there is arranged a handle 21 that carries an actuation switch 22 with which a setting process is initiated, and an ignition device 23 such as, e.g., a spark plug, in the combustion chamber is actuated. The actuation switch 22 is pivotally supported on a support 24 provided on the handle 21.

A bar-shaped displacement member 32 is displaceably supported in a second guide 36 provided on the press-on member 26. The displacement member 32 is supported against displacing means 33 that is supported against a stop 37 that is provided on the press-on member 26. The displacing means 33 is formed as a spring, in particular as a helical spring. The displacement member 32 and the displacing means 33 form means for overpowering the holding force of the magnetic elements 31. The displacement member 32 abuts, with its displacement surface 35, a free end of a bar-shaped guide member 27 secured to the plate-shaped member 17, extending transverse thereto. The guide member 27 is displaced, on one hand, in a first guide 28 provided on the guide cylinder 12 and, on the other hand, projects into the combustion chamber 14 through a second opening 49 in the combustion chamber wall 38. In the initial position of the setting tool 10 shown in FIG. 1, a lock member 34, which is connected with the actuation switch 22 and forms part of the means for overpowering the holding force of the magnetic elements 31, engages the displacement surface 35 of the displacement member 32.

In FIG. 2, the setting tool 10 is pressed with the bolt guide 25 against the workpiece W, whereby the bolt guide 25 is displaced in a direction shown with a first arrow 41, into the housing 11. Upon displacement of the bolt guide 25 into the housing 11, the distance between the bolt guide 25 and the guide cylinder 12 is reduced, and the spring 40 becomes compressed. The press-on element 26, which is connected with the bolt guide 25, and the set member 29 displace the combustion chamber rear wall 19 in direction of the second arrow 42 toward the second end 16 of the combustion chamber sleeve 18 or the combustion chamber 14, expanding the combustion chamber 14. The plate-shaped member 17 remains, in the press-on condition of the setting tool 10, in its position in which it abuts the first end 15 of the combustion chamber sleeve 18 or the combustion chamber 14, being retained in this position by magnetic elements 31. The displacing means 33 remains in its compressed position between the stop 37 on the press-on element 26 and a support surface of the displacement member 32, being retained in the compressed position by the lock member 34. During or after expansion of the combustion chamber 14, an ignitable air-fuel mixture is fed thereinto.

FIG. 3 shows a position of the setting tool 10 in which the actuation switch 22 has been actuated and pivoted in direction of a third arrow 43. As a result of the pivotal movement of the actuation switch, the lock member 34, which is connected with the actuation switch 22, has been pivoted out of its engagement position with the displacement member 32 or the displacement surface 35 of the displacement member 32. As a result, the displacement member 32 is displaced in direction of a fourth arrow 44 by the displacing means 33. The displacement surface 35 applies a force to the guide member 27 that exceeds the cumulative holding force of the magnetic elements 31, overpowering the magnetic force of the magnetic elements 31. The plate-shaped member 17 becomes free of the magnetic force and is likewise displaced in the direction of the arrow 44. The displacement of the plate-shaped member 17 through the combustion chamber 14, which is filled with the air-fuel mixture, creates turbulence in the combustion chamber. By a spark 50, which is produced by the ignition device 23, the air-fuel mixture is ignited during or after displacement of the plate-shaped member 17. The combustion energy provides for displacement of the setting piston 13 in direction of a fifth arrow 45, which drives a fastening element into the workpiece W.

Upon lifting of the setting tool 10 off the workpiece W, the press-on element 26, which is subjected to the biasing force of the spring 40, displaces the combustion chamber rear wall 19 to its initial position at the first end 15 of the combustion chamber 14 or the combustion chamber sleeve 18. Upon its displacement, the combustion chamber rear wall 19 entrains the plate-shaped member 17, displacing it likewise to its initial position at the first end 15 in which it is held by magnetic elements 31. To this end, the biasing force of the spring 40 exceeds that of the displacing means 33.

Alternatively, to the embodiment described above, the combustion chamber rear wall can be fixedly secured at the second end of the combustion chamber sleeve. The combustion chamber sleeve then can be displaceable relative to the guide cylinder or remain stationary relative thereto. In the latter case, the plate-shaped member would be displaceable relative to the guide cylinder in the combustion chamber between the first and second end of the combustion chamber or the combustion chamber sleeve.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A combustion-engined setting tool for driving fastening elements in a workpiece, comprising:

a combustion chamber (14) for an oxidant-fuel gas mixture;

a guide cylinder (12) adjoining the combustion chamber at one end thereof;

a setting piston (13) displaceable in the guide cylinder (12) for driving a fastening element in the workpiece;

a plate-shaped member (17) axially displaceable in the combustion chamber (14) for creating turbulence therein;

displacing means (33) for displacing the plate-shaped member (17);

a holding device (30) for retaining the plate-shaped member (17) at an axial end (15) of the combustion chamber (14) against action of the displacing means (33), the holding device (30) having magnetic means (31) for producing a holding force for retaining the plate-shaped member (17); and means for overpowering the holding force produced by the magnetic means (31).

2. A combustion-engined setting tool according to claim 1, wherein the overpowering means is actuated by an actuation switch (22) of the setting tool.

3. A combustion-engined setting tool according to claim 2, wherein the overpowering means comprises a displacement member (32) displaceable by the displacing means (33), and a lock member (34) connected with the actuation switch (22) for locking the displacement member (32) in an initial position thereof in a non-actuated position of the actuation switch (22).

4. A combustion-engined setting tool according to claim 3, wherein the displacing means (33) is formed as a spring, and the setting tool further comprises a press-on element (26) which preloads the displacing means-forming spring against the displacement member (32).

5. A combustion-engined setting tool according to claim 3, further comprising a guide member (27) engaging the plate-shaped member (17) and cooperating with the displacement member (32).

6. A combustion-engined setting tool according to claim 5, wherein the guide member (27) is formed as a bar-shaped member and is displaceable, at least partially, in a first guide (28) provided on the guide cylinder (12).

7. A combustion-engined setting tool according to claim 3, wherein the displacement member (32) is formed as a bar-shaped member, and the setting tool further comprises a second guide (36) provided on the press-on element (26) and in which the displacement member-forming, bar-shaped member is at least partially displaceable.

8. A combustion-engined setting tool according to claim 1, wherein the magnetic means (31) comprises at least two magnetic elements.

9. A combustion-engined setting tool according to claim 1, wherein the magnetic means (31) is formed as permanent magnetic means.

* * * * *